US006209360B1

(12) United States Patent
Majer et al.

(10) Patent No.: US 6,209,360 B1
(45) Date of Patent: Apr. 3, 2001

(54) LATCH NEEDLE HAVING A LATCH SUPPORTED ON A PIN

(75) Inventors: Sigmar Majer, Balingen; Bernhard Schuler, Sonnenbühl, both of (DE)

(73) Assignee: Groz Beckert KG, Albstadt (DE)

( * ) Notice: Subject to any disclaimer, the term of this patent is extended or adjusted under 35 U.S.C. 154(b) by 0 days.

(21) Appl. No.: 09/537,545

(22) Filed: Mar. 30, 2000

(30) Foreign Application Priority Data

Apr. 1, 1999 (DE) ..... 199 14 928

(51) Int. Cl.[7] ..... D04B 35/04
(52) U.S. Cl. ..... 66/122
(58) Field of Search ..... 66/116, 121, 122; 163/3, 5

(56) References Cited

U.S. PATENT DOCUMENTS

| | | | | |
|---|---|---|---|---|
| 1,991,140 | * | 2/1935 | Currier | 66/122 |
| 3,022,651 | * | 2/1962 | Gauld . | |
| 3,526,104 | * | 9/1970 | Beighton et al. | 66/122 |
| 3,850,011 | * | 11/1974 | Shepard et al. | 66/122 |
| 4,020,319 | | 4/1977 | Shepard et al. . | |
| 5,509,280 | * | 4/1996 | Schuler et al. | 66/121 |

FOREIGN PATENT DOCUMENTS

| | | | | |
|---|---|---|---|---|
| 681690 | * | 3/1964 | (CA) | 66/122 |
| 608619 | | 1/1935 | (DE) . | |
| 1499561 | * | 10/1967 | (FR) | 66/122 |
| 1 588 410 | | 4/1981 | (GB) . | |

* cited by examiner

*Primary Examiner*—Danny Worrell
(74) *Attorney, Agent, or Firm*—Venable; Gabor J. Kelemen

(57) ABSTRACT

A latch needle includes a head; a cheek having two facing side walls each having an inner wall face and an outer wall face; a sawslot defined by the inner wall faces of the side walls; and a pivot pin being formed at least on one of the side walls by plastically deforming the side wall. The pivot pin extends from the inner wall face of the side wall into the sawslot. The latch needle further has a first depression provided in the outer wall face of the side wall in alignment with the pivot pin. The first depression includes a bottom having a peripheral region in which a second depression is provided. A needle latch cooperates with the head and has a latch shank accommodated in the sawslot. The latch shank has a hole into which the pivot pin extends for forming a bearing support for the needle latch.

20 Claims, 6 Drawing Sheets

LATCH NEEDLE HAVING A LATCH SUPPORTED ON A PIN

CROSS REFERENCE TO RELATED APPLICATION

This application claims the priority of German Application No. 199 14 928.3 filed Apr. 1, 1999, which is incorporated herein by reference.

BACKGROUND OF THE INVENTION

This invention relates to a latch needle having a head (hook) cooperating with a pivotally supported latch. The latch needle further has a needle cheek which is provided with a sawslot defined between two side walls of the needle cheek. The latch has a latch shank accommodated in the sawslot and provided with a latch hole. The latch needle further has at least one latch bearing which is formed by at least one projection constituted by a plastic deformation of at least one of the cheek side walls. The material from which the projection is formed leaves a depression in the respective side wall. The projection extends into the hole of the needle latch. Latch needles of this type are used, for example, in knitting machines.

The latch may be pivoted into a first position in which the latch lies on the free end of the needle head and a second position in which the latch is swung away from the head and thus opens the same. In this arrangement an accurate support of the latch is very important. The latch has to move freely to ensure that it may be pivoted back and forth by small operating forces. On the other hand, the latch has to be guided with such an accuracy that, in the course of the closing motion, the latch spoon arrives into a precise engagement with the hook. Such a result has to be ensured for the entire service life of the latch needle.

As noted earlier, the latch is usually supported on the latch needle by a pin extending through a latch hole which is provided in the needle latch for this purpose. In the vicinity of the needle head a cheek region is formed which has a sawslot. On both sides of the sawslot side walls are arranged from which a pin is formed or between which a separate pivot pin is held. The latch shank extends between the side walls into the sawslot and journals on the pin.

Various embodiments have become known for forming a pin to support the latch or for inserting a pin into holes provided in the side walls of the needle cheek. Thus, U.S. Pat. No. 3,526,104, to which corresponds German Offenlegungsschrift (application published without examination) 15 85 091 discloses a latch needle having an inserted pivot pin. The holes which are provided for receiving the pivot pin in the side walls of the needle cheek are in alignment with one another and conically flare towards the outer side faces of the needle. The pivot pin is a separately made wire component which is inserted into the aligned holes and is riveted at both ends whereby convex rivet heads are formed.

U.S. Pat. No. 5,509,280 discloses a latch needle in which, for supporting the latch, two obliquely adjoining half pins are provided which are pressed out from the side walls defining the sawslot. The half pins are of asymmetrical configuration related to the pivot axis of the latch. The half pins are formed by plastically deforming the side walls with a suitable puncturing tool. The penetration depth of the tool is not constant along the circumference of each pin, whereby the flow conditions of the material are not uniform along the circumference.

Further, for supporting a latch on a latch needle, it is known from German Patent No. 608,619 to make half pins by plastic deformation of the side walls on both sides of the sawslot. For this purpose, puncturing tools with planar end faces are used. The puncturing tools have at their frontal end a cylindrical bit with a planar end face whose diameter is smaller than the diameter of the half pin to be made.

The half pins form projections which extend into the sawslot and penetrate into the latch hole. The purpose of this arrangement is to ensure a lasting, accurate positioning of the latch.

SUMMARY OF THE INVENTION

It is an object of the invention to provide an improved latch needle which ensures a durable and accurate functioning of the needle latch.

This object and others to become apparent as the specification progresses, are accomplished by the invention, according to which, briefly stated, the latch needle includes a head; a cheek having two facing side walls each having an inner wall face and an outer wall face; a sawslot defined by the inner wall faces of the side walls; and a pivot pin being formed at least on one of the side walls by plastically deforming the side wall. The pivot pin extends from the inner wall face of the side wall into the sawslot. The latch needle further has a first depression provided in the outer wall face of the side wall in alignment with the pivot pin. The first depression includes a bottom having a peripheral region in which a second depression is provided. A needle latch cooperates with the head and has a latch shank accommodated in the sawslot. The latch shank has a hole into which the pivot pin extends for forming a bearing support for the needle latch.

Thus, stated generally, the object of the invention is achieved by increasing the pin's carrier part which is ideally 100% of the latch thickness.

The latch needle according to the invention has, for providing a latch support, at least one projection formed by plastic deformation. The projection extends into the sawslot and penetrates into the latch hole of a needle latch accommodated in the sawslot. The projection thus forms a pin or a half pin for supporting the latch. On the outer side faces of the needle shank, in an axial prolongation of the depression, a further, second depression is provided which preferably extends parallel to the circumference of the pin and may be interrupted or subdivided. The additional depression positively affects the flow of material when the projection (pivot pin) is formed. By virtue of this arrangement it is feasible to obtain a pin or half pins with only a slight bulging of the free end face thereof. Thus, the end face of the pivot pin may be maintained relatively planar so that the size of the lateral pin surface serving for supporting the latch may be maximized. The axially measured height of such a lateral surface is ideally identical to the latch thickness.

In case of a symmetrical construction, both side walls are provided with depressions and each has an additional depression. The pins produced in this manner abut each other approximately in the middle of the sawslot. By virtue of their planar end faces the width of the gap between the lateral surfaces of the two pins, that is, the approximately annular interruption of the latch supporting surface is minimized, regardless of whether the half pins (projections) are welded to one another at their end faces. The obtained maximization of the supporting surface and the only slight deformation of the inner flanks of the sawslot provide for a durable and accurate (that is, a small-clearance) latch support so that latch needles operate with high precision even after a long service. Such a result is made possible by the depression which is provided in the outer side face of the needle and which has at least one further depression adjoining its bottom. The configurations of the depressions may have different embodiments. Thus, for example, the bottom may be surrounded by a circumferentially extending uninterrupted groove and may otherwise be of arcuate or planar shape. It is also feasible to interrupt the groove (that is, the second depression) once or several times. The groove may adjoin directly the wall of the first depression in which case it is then arranged radially externally of the first depression. It is furthermore possible that it is arranged further inwardly and to form an annular step between the wall of the first depression and the groove.

A stepped transitional region may be provided between a groove situated at the outer periphery of the bottom of the second depression and the planar or arcuate middle zone. Such a region may be a conical annular surface or a real step formed as an almost cylindrical annular surface. The annular groove provided in the bottom of the first depression may have a groove bottom and groove flanks which have a curvilinear transition into one another. The radius of the transition is preferably significantly smaller than one-half of the groove width, preferably smaller than one-third or one-fourth of the groove width. The radius depends from the latch needle.

The middle region of the first depression is preferably planar. It may be, however, of concave configuration in sections or may be provided with further depressions. It is essential for the configuration of the depressions according to the invention that an external region is provided which is deeper than a middle region. The external region does not have to be annularly continuous.

Advantageously, the depressions have an essentially cylindrical wall face. The diameter of the depressions is expediently as large as the diameter of the projection (that is, the pin or half pin). It may, however, also be advantageous to provide slightly different diameters.

The projection is formed from the side wall defining the sawslot and is preferably connected therewith. Such a connection prevents a separation of the projection from the latch needle even after prolonged service.

DESCRIPTION OF THE PREFERRED EMBODIMENTS

Figure 1:
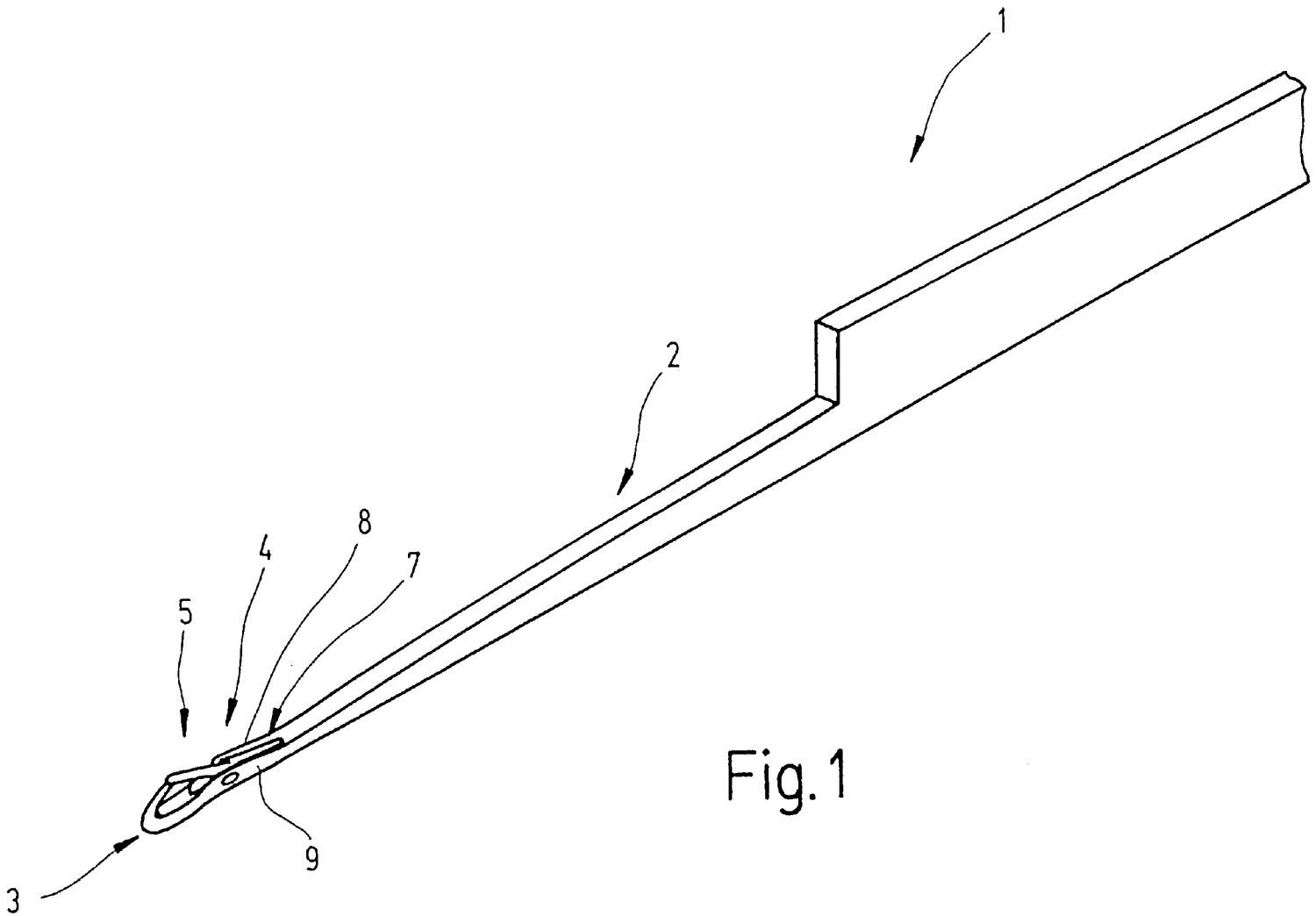
FIG. 1 is a schematic perspective view of a frontal part of a latch needle incorporating the invention.
Figure 2:
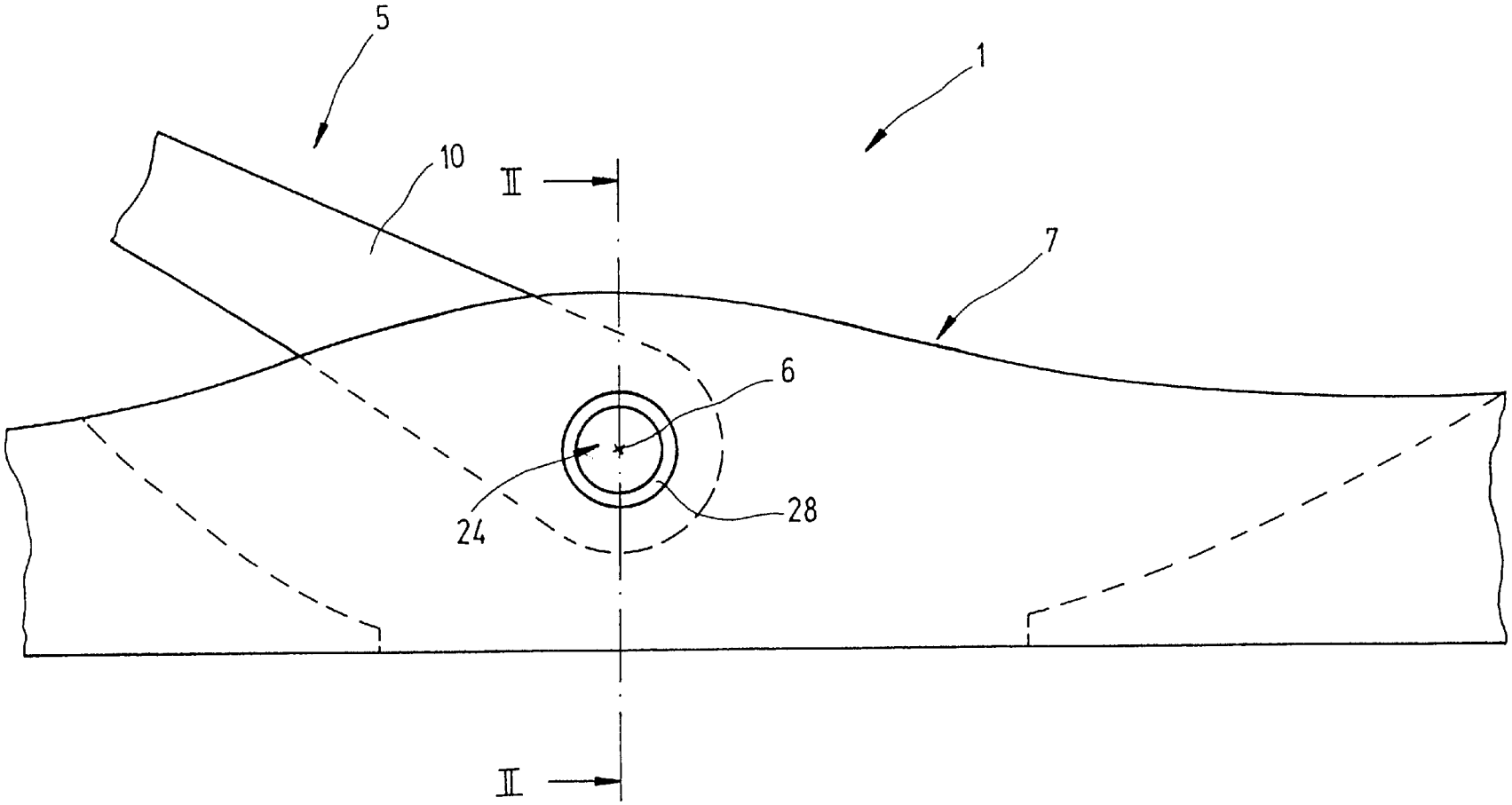
FIG. 2 is an enlarged side elevational view of one part of FIG. 1.

Turning to FIG. 1, the latch needle generally designated at 1 has a shank 2 having a frontal end which carries a hook-shaped head 3. Between the head 3 and the shank 2 a slightly bulging needle portion is provided which constitutes a cheek 4. The cheek 4 serves for holding a latch 5 which is supported for pivotal motion about a rotary axis 6 as shown in FIG. 2. The latch 5 extends with the latch shank 10 into a sawslot 7 which traverses the needle cheek 4 and divides the latter into two lateral walls 8 and 9.

Figure 3:
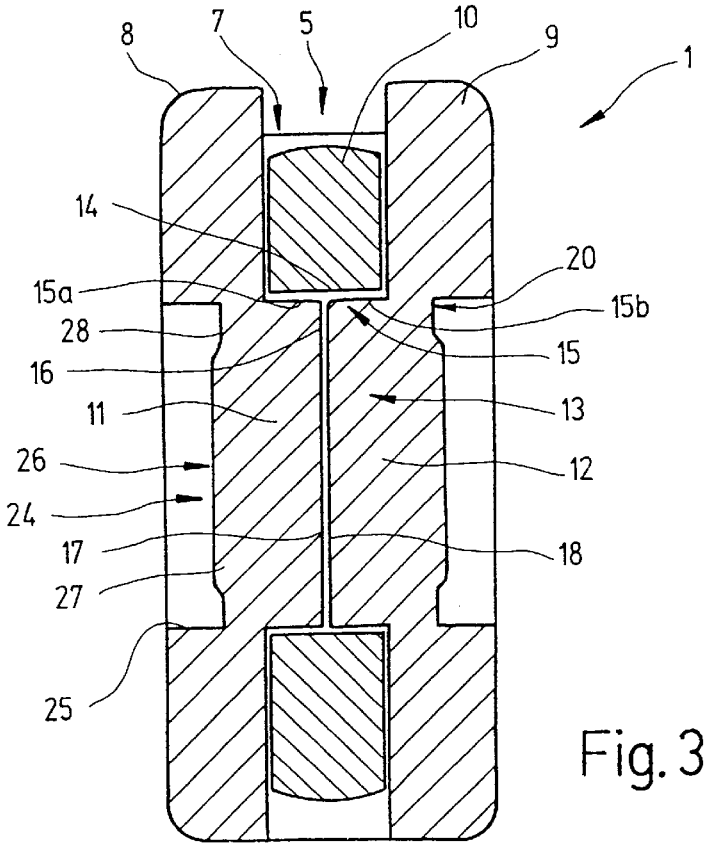
FIGS. 3, 4, 5, 5*a*, 6 and 6*a* are sectional end elevational views of six preferred embodiments of the invention, each taken along section line II—II of FIG. 2.

Also referring to FIGS. 2 and 3, for supporting the latch 5 about the rotary axis 6 oriented transversely to the needle shank 2, half pins 11 and 12 are provided which are connected with the respective side walls 8, 9. The half pins 11, 12 thus form a common bearing 13 for the latch 5 and its latch shank 10. The latch shank 10 is provided with a latch hole 14 into which extend, from opposite sides of the latch shank 10, the two half pins 11 and 12 which thus together define an essentially cylindrical bearing surface 15 whose diameter is slightly less than the diameter of the latch hole 14. Approximately centrally along its length, the bearing surface 15 is interrupted by a gap 16 where the end faces of the half pins 11 and 12 are in close proximity or are in abutment with one another. The bearing face 15 is thus subdivided into individual partial bearing faces 15*a* and 15*b*. The partial bearing face 15*a* constitutes the circumferential surface of the half pin 11 whereas the partial bearing face 15*b* constitutes the lateral face of the half pin 12.

Figure 7:
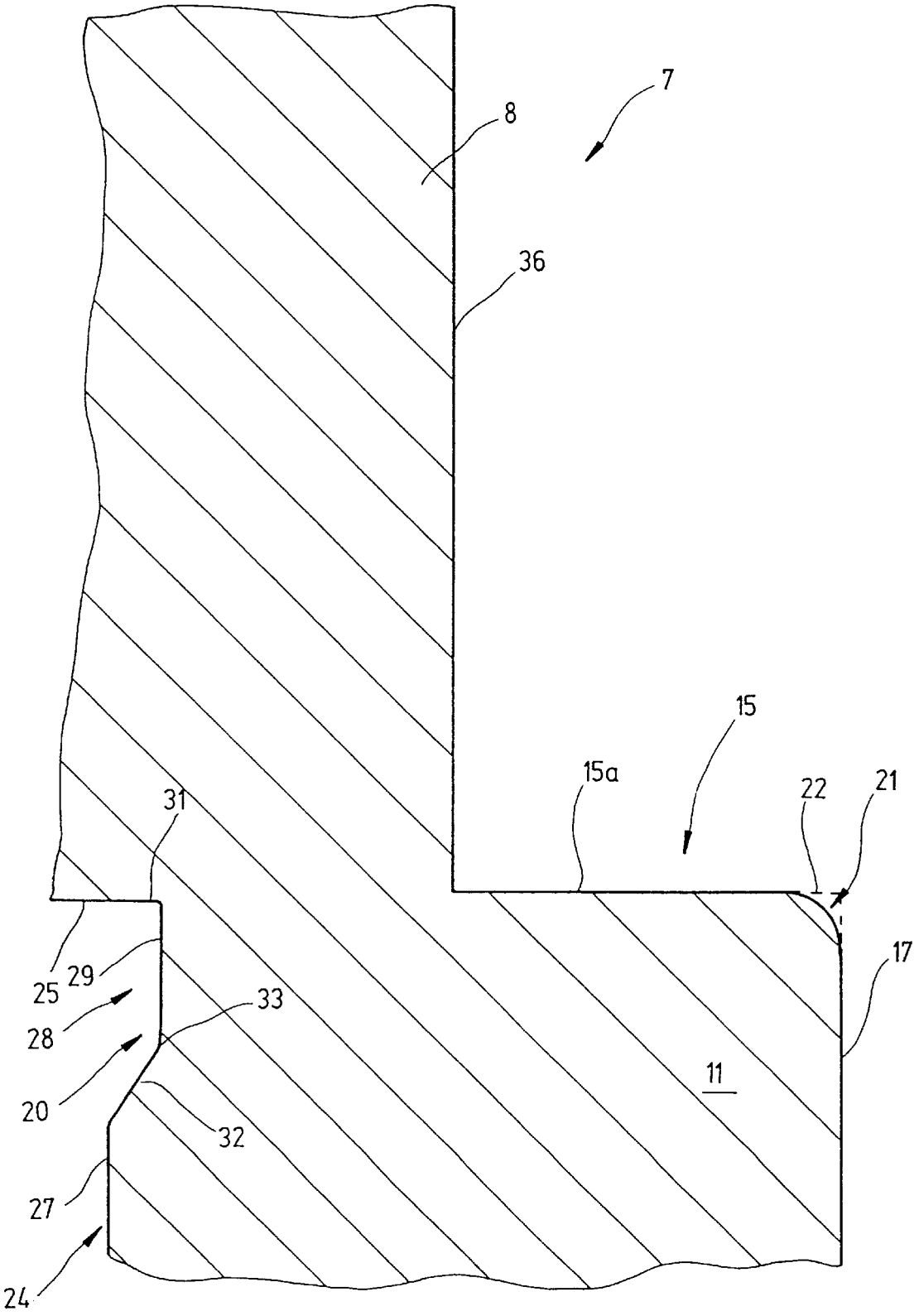
FIG. 7 is an enlarged sectional view of one part of the structure shown in FIG. 3.

The geometrical relationships are also shown in detail in FIG. 7. The end face 17 of the half pin 11 is essentially planar and the partial bearing face 15*a* is essentially cylindrical. A transitional region 21 between the end face 17 and the partial bearing face 15*a* is rounded; in case of an ideal cylindrical shape the region 22 shown in phantom line in FIG. 7 is very small or is missing altogether.

As may be seen in FIGS. 3 and 7, in an axial prolongation of the half pin 11 a depression 24 is formed which has essentially a cylindrical lateral surface 25 having approximately the same diameter as the half pin 11. The depression 24 has a bottom 26 adjoined by at least one further depression 20. Stated differently, a mid region 27 projects axially beyond an outer region 28 which extends along the periphery of the bottom 26. The second depression 20 is situated along the edge zone of the latch hole 14. The second depression 20 is an annular groove and has, as particularly well seen in FIG. 7, an essentially planar groove bottom 29 which is adjoined outwardly by a groove flank which may be formed by the cylindrical wall face 25. The transition between the groove bottom 29 and the wall face 25 is formed by an arcuate surface region 31 which has a relatively small radius.

Between the groove bottom 29 of the second depression 20 and the mid region 27 a conical groove flank (annular surface) 32 is provided which joins the groove bottom 29 with an arcuate surface region 33. The surface region 33 is preferably also rounded and has a small radius of curvature.

The side wall 8 has at its side oriented towards the sawslot 7 a substantially planar flank 36 which extends to the partial bearing surface 15*a* of the half pin 11. The latch 5 is guided by the respective flanks of the sawslot 7 such that the latch 5 is essentially prevented from tilting laterally notwithstanding its low-friction pivotal support about the rotary axis 6. The relatively large-surface guidance of the latch 5 makes possible an accurate prolonged service. The same applies to the bearing surfaces 15*a*, 15*b* of the respective half pins 11, 12. The bearing surface 15 is almost closed, that is, the gap 16 has ideally a zero width.

The half pins 11 and 12 are components of the respective side walls 8 and 9. They are obtained by plastically deforming the side walls 8 and 9. If required, the end faces 17, 18 of the respective half pins 11, 12 may be welded to one another, for example, by a laser beam which is directed into the depression 24.

The half pins 11, 12 are preferably arranged in mirror symmetry; thus the earlier description relating to the half pin 11 applies equally to the half pin 12. In other embodiments, no such mirror symmetry of the half pins exists.

Figure 4:
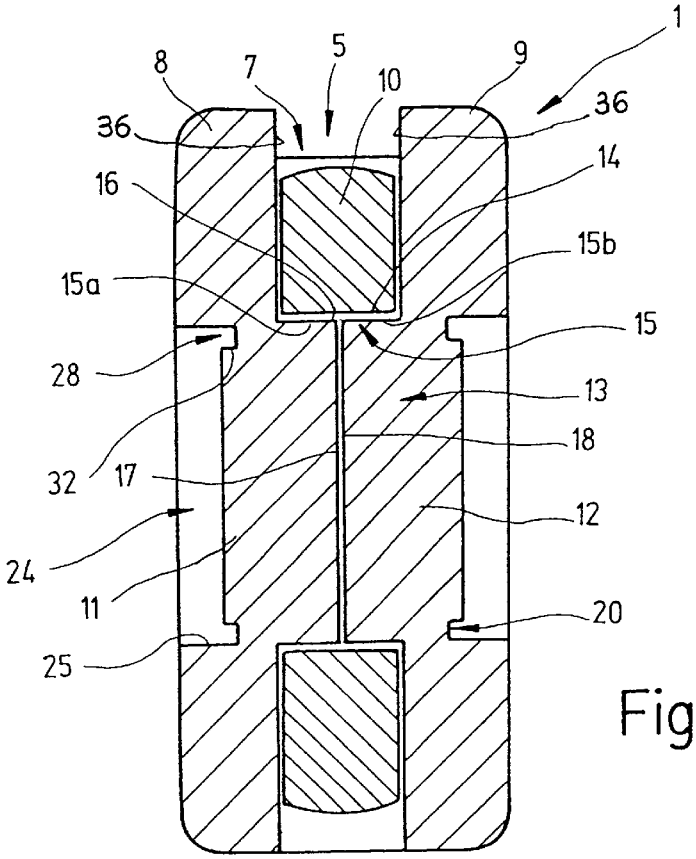

While in the embodiment of the latch needle 1 described in connection with FIGS. 3 and 7 the width of the second depression 20 is in the outer region 28 greater than its depth and the groove flank 32 is frustoconical, the relationships in the embodiment shown in FIG. 4 are slightly different: The second depression 20 has an approximately quadratic cross section in the outer region 28 and the groove flank 32 has thus a cylindrical surface. It is also possible to dimension the groove width to be greater or smaller than the groove depth. In other aspects, the structural features of the FIG. 4 embodiment are the same as those described in connection with FIGS. 3 and 7. The second depression 20 in the outer region 28 makes possible to produce the half pins 11 and 12 with an approximately cylindrical shape whereby the size of the bearing surface 15 is maximized.

Figure 5:
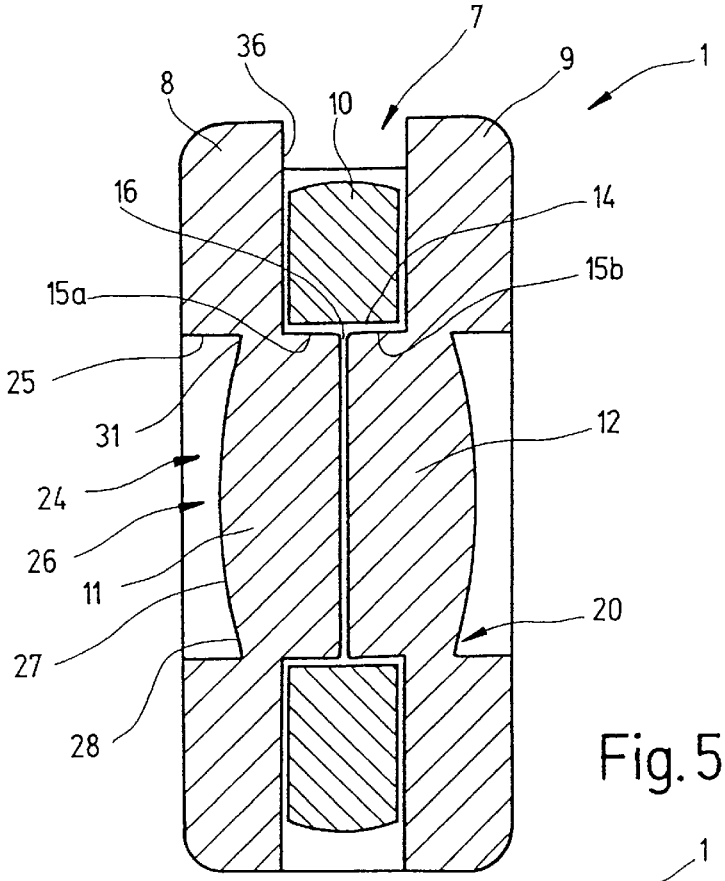

A further embodiment of the latch needle according to the invention is illustrated in FIG. 5. This embodiment too, differs from the embodiments of FIGS. 3 and 4 in the configuration of the depression 24. As in the previous embodiments, the wall 25 of the depression 24 is approximately cylindrical and has essentially the same diameter as the partial bearing surface 15*a* of the half pin 11. The same applies to the half pin 12. As a departure from the previously described embodiments, the bottom 26 of the depression 24 is arcuate in its entirety. Its mid region 27 immediately changes to the second depression 20 in the outer region 28 which, instead of a groove, forms the edge of a spherically convex surface. The transition between the second depression 20 and the wall 25 is formed by the surface region 31 which has a very small radius of curvature. In this embodiment too, it is feasible to obtain at least approximately planar flanks 36 in the sawslot 7 and at least approximately cylindrical partial bearing surfaces 15*a,* 15*b* for the half pins 11 and 12. In all other aspects, this embodiment corresponds to those previously described.

Figure 6:
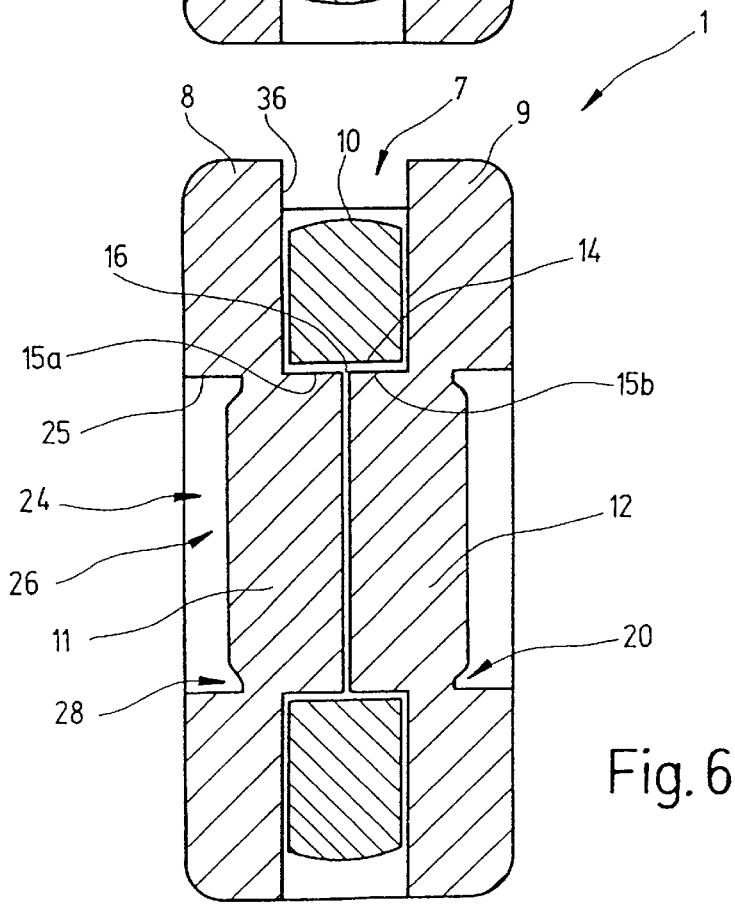

A further embodiment of the latch needle 1 according to the invention is illustrated in FIG. 6. The latch needle 1 shown therein differs from the latch needle according to FIG. 3 essentially in that the depth of the second depression 20 is greater than its width. This embodiment too, makes possible to obtain an essentially cylindrical half pin 11, 12 on which the carrier portion (that is, the partial bearing surfaces 15*a,* 15*b* of the bearing surface 15) is relatively large. Ideally, it is identical to the latch thickness and the gap 16 situated between the two partial bearing surfaces 15*a* and 15*b* is relatively narrow and ideally equals zero. Stated differently, the half pins 11, 12 may have a relatively sharp-edged transition between the end faces 17, 18 and the respective partial bearing surfaces 15*a,* 15*b*.

In the embodiment illustrated in FIGS. 3–6 the end faces 17, 18 of the respective half pins 11, 12 extend parallel to one another and to the respective flanks 36 of the side walls 8, 9.

Figure 5A:
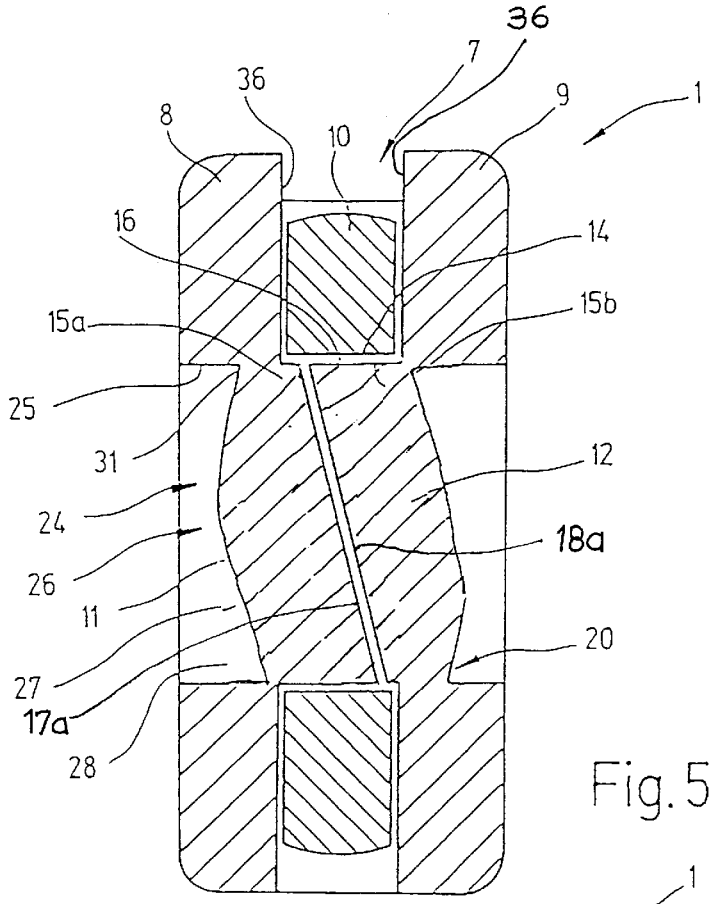
Figure 6A:
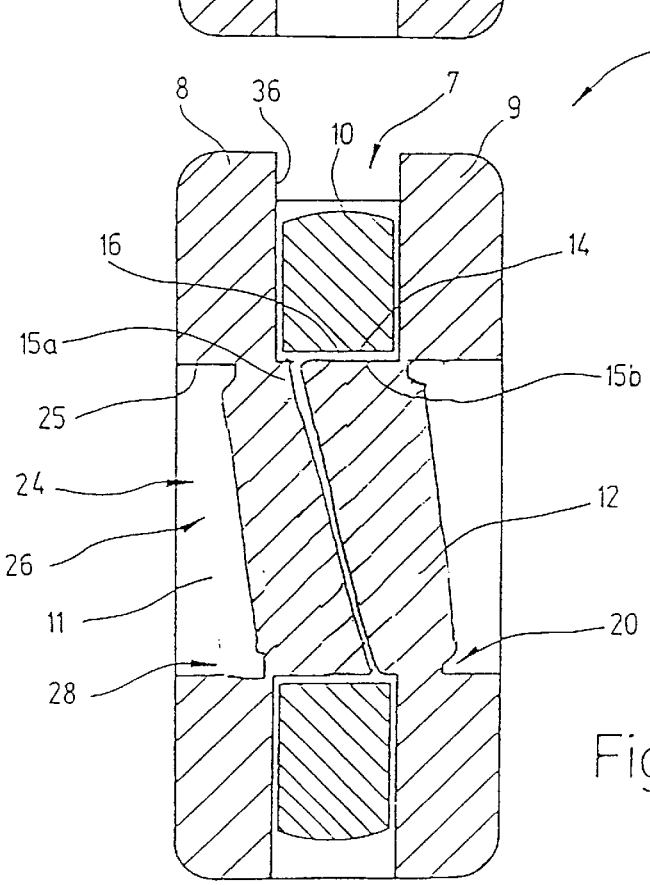

In the embodiments shown in FIGS. 5*a,* 6*a,* on the other hand, while the end faces 17*a* and 17*b* of the respective half pins 11, 12 extend parallel to one another, they are oriented obliquely (that is, at an angle other than zero) to the respective flanks 36 of the side walls 8, 9.

It will be understood that the above description of the present invention is susceptible to various modifications, changes and adaptations, and the same are intended to be comprehended within the meaning and range of equivalents of the appended claims.

What is claimed is:

1. A latch needle comprising (a) a head;

(b) a cheek having two facing side walls each having an inner wall face and an outer wall face; said inner wall faces of said side walls defining a sawslot;

(c) a pivot pin being formed at least on one of said side walls by plastically deforming said one side wall; said pivot pin extending from the inner wall face of said one side wall into said sawslot;

(d) a first depression provided in said outer wall face of said one side wall in alignment with said pivot pin; said first depression including a bottom having a peripheral region;

(e) a second depression provided in said peripheral region; said second depression having a substantially planar bottom; and (f) a needle latch cooperating with said head and having a latch shank accommodated in said sawslot; said latch shank having a hole into which said pivot pin extends for forming a bearing support for said needle latch.

2. The latch needle as defined in claim 1, wherein said first depression has a substantially cylindrical wall face.

3. The latch needle as defined in claim 1, wherein said pivot pin has an end face oriented substantially parallel to said inner face of said one side wall.

4. The latch needle as defined in claim 1, wherein said peripheral region is annular; further wherein said bottom of said first depression has a mid region, and said second depression has a greater depth measured from said outer face of said one side wall than said mid region.

5. The latch needle as defined in claim 4, wherein said mid region is planar.

6. The latch needle as defined in claim 4, wherein said mid region is arcuate.

7. The latch needle as defined in claim 4, further comprising a stepped transitional region between said mid region and said second depression; said transitional region including a frustoconical annular surface.

8. The latch needle as defined in claim 4, wherein said second depression has a width greater than a depth thereof.

9. The latch needle as defined in claim 4, wherein said second depression is continuous.

10. The latch needle as defined in claim 4, wherein said first depression has a depth measured from said outer face of said one side wall; said depth being substantially equal to an axial length of said pivot pin.

11. The latch needle as defined in claim 1, wherein said first depression has a circumferential lateral wall face surrounding said peripheral region; further wherein said second depression is formed by an annular groove having a width, a groove bottom, an outer groove flank constituted by said circumferential lateral wall face of said first depression and an inner groove flank adjacent said bottom of said first depression; further comprising rounded transitions from said groove bottom to said inner and outer groove flanks; said transitions having a radius of curvature less than one half of said width of said annular groove.

12. The latch needle as defined in claim 11, wherein said transitions have a radius of curvature less than one third of said width of said annular groove.

13. The latch needle as defined in claim 11, wherein said transitions have a radius of curvature less than one fourth of said width of said annular groove.

14. The latch needle as defined in claim 1, wherein said second depression is located essentially in a zone corresponding to a peripheral region of said hole in said latch shank.

15. A latch needle comprising (a) a head;

(b) a cheek having two facing side walls each having an inner wall face and an outer wall face; said inner wall faces of said side walls defining a sawslot;

(c) a pivot pin being formed on each of said side walls by plastically deforming said side walls; the pivot pins extending from the inner wall face of respective said side walls into said sawslot;

(d) a first depression provided in said outer wall face of each said side wall in alignment with said pivot pin; said first depression including a bottom having a peripheral region;

(e) a second depression provided in said peripheral region; said second depression having a substantially planar bottom; and (f) a needle latch cooperating with said head and having a latch shank accommodated in said sawslot; said latch shank having a hole into which said pivot pins extend for forming a bearing support for said needle latch.

16. The latch needle as defined in claim 15, wherein said pivot pins have a cylindrical surface together forming said bearing support.

17. The latch needle as defined in claim 15, wherein said pivot pins have substantially planar end faces oriented toward one another.

18. The latch needle as defined in claim 17, wherein said end faces contact one another.

19. The latch needle as defined in claim 15, wherein each said pivot pin has an end face oriented substantially parallel to said inner faces.

20. The latch needle as defined in claim 15, wherein each said pivot pin has an end face oriented to said inner faces at an angle other than zero.

* * * * *